US006237190B1

(12) United States Patent
Grumm et al.

(10) Patent No.: US 6,237,190 B1
(45) Date of Patent: May 29, 2001

(54) DUAL LINK DOOR CHECK

(75) Inventors: Darren M. Grumm, Cassopolis; Mark L. Smith, Niles, both of MI (US); Todd E. Cripe, Goshen, IN (US)

(73) Assignee: Atwood Mobile Products, Inc., Rochester Hills, MI (US)

( * ) Notice: Subject to any disclaimer, the term of this patent is extended or adjusted under 35 U.S.C. 154(b) by 0 days.

(21) Appl. No.: 09/223,152

(22) Filed: Dec. 30, 1998

(51) Int. Cl.[7] ..... E05F 5/02
(52) U.S. Cl. ..... 16/82
(58) Field of Search ..... 16/82, 86 C, 86 R, 16/86 A; 292/DIG. 19, 277, 262; 296/146.12, 146.11

(56) References Cited

U.S. PATENT DOCUMENTS

| | | | | |
|---|---|---|---|---|
| 1,521,635 | | 1/1925 | Lewis | 52/67 |
| 2,704,223 | | 3/1955 | Houdart | 296/26.13 |
| 2,813,747 | | 11/1957 | Pice, Jr. | 296/171 |
| 4,102,005 | * | 7/1978 | Schnarr et al. | 16/49 |
| 4,833,755 | * | 5/1989 | Bonin | 16/344 |
| 5,074,010 | * | 12/1991 | Gignac et al. | 16/334 |
| 5,152,030 | * | 10/1992 | Cogo | 16/86 C |
| 5,154,469 | | 10/1992 | Morrow | 296/26.02 |
| 5,173,991 | * | 12/1992 | Carswell | 16/86 A |
| 5,332,276 | | 7/1994 | Blodgett, Jr. | 296/26.13 |
| 5,333,420 | | 8/1994 | Eden | 52/67 |
| 5,474,344 | * | 12/1995 | Lee | 292/262 |
| 5,491,933 | | 2/1996 | Miller et al. | 52/67 |
| 5,570,924 | | 11/1996 | Few et al. | 296/175 |
| 5,586,802 | | 12/1996 | Dewald, Jr. et al. | 296/26.14 |
| 5,607,134 | | 3/1997 | Corning et al. | 248/354.3 |
| 5,634,683 | | 6/1997 | Young | 296/165 |
| 5,862,570 | * | 1/1999 | Lezuch et al. | 16/82 |

FOREIGN PATENT DOCUMENTS

| | | | |
|---|---|---|---|
| 0 567 003 A1 | * | 10/1993 | (EP) . |
| 1 387 137 | * | 3/1975 | (GB) . |

* cited by examiner

*Primary Examiner*—Anthony Knight
*Assistant Examiner*—Robert L. Pilaud
(74) *Attorney, Agent, or Firm*—Robert K. Roth

(57) ABSTRACT

A door check for holding a door in an open position is disclosed, which is particularly useful for thin doors. The door check comprises a check body attached to the door and having an opening. The door check pivots with the door about a first axis. A main link is slidable through the door check opening as the door pivots. A second link is pivotably attached to the main link, and pivotably about a second axis with respect to a rigid member. As the check body pivots about the first axis, the second link pivots about the second axis and the main link translates through the opening in the check body. The main link may have an irregular surface so that a large force may be required to move the door back from the open position to a closed position.

10 Claims, 5 Drawing Sheets

DUAL LINK DOOR CHECK

FIELD OF THE INVENTION

The present invention generally relates to a new and improved door check for holding a pivoting member relative to a fixed member, and more particularly to door checks for holding a door in a given position with respect to a motor vehicle.

BACKGROUND OF THE INVENTION

Door checks have been used for many years in many kinds of doors, including recreational vehicle doors. The door check comprises a link and a check body. The link is typically attached to a fixed member, such as the structural body of a vehicle or a door jamb, and the check body is attached to a door. When the door is opened, the check body moves with the door. The link rotates, and since the check body and the link are not rotating about the same axis, the check body slides with respect to the link. Typically the main link has a ramped surface and a recessed surface, often referred to as a detent or well, and the check body has a roller or bearing that rolls or slides over the main link. As the check body moves across the ramped surface the amount of force needed to move the door increases. Then, once the check body moves past the ramped surface to the well, the amount of force required to move the door drops. Thus, the door is temporarily held in a hold-open position which can be overcome only by applying additional force to the door to permit the roller to move back over the ramped surface.

A problem with this kind of design is that the sweep of the link requires a great deal of space in the door. This is especially a problem for thin doors such as those used in recreational vehicles and trucks. To accommodate the sweep of the link, a large portion of material in such doors has to be removed, reducing the structural integrity of the door and increasing the likelihood of problems with wind noise and water penetration behind the door. Moreover, the door check must be made large to accommodate the large change in the angle between the link and the door check as the door pivots from open to closed positions.

Therefore it would be highly desirable to provide a door check which can be installed in a thin door, such as those common in recreational vehicles and trucks, without interfering with the structural integrity, aesthetics and element-resisting features of the door.

In view of the foregoing, it is an object of the present invention to provide a door check which reduces interference with the structural integrity of the door. It is another object of the present invention to provide a door check which is easy to assemble and which is highly reliable in operation.

SUMMARY OF THE INVENTION

In accordance with these and other objects, there is provided a door check having a check body, a main link, and a second link. The check body is adapted to pivot with respect to a fixed member, and is provided with an opening. The main link is linearly slidable through the opening of the check body in response to pivoting of the check body. The second link is pivotably connected to the main link and adapted to pivot with respect to the fixed member. In response to pivoting of the check body, the second link pivots. Preferably the check body is positioned in and attached to a door so that the door and check body pivot together. The fixed member can be, for example, a door jamb.

The main link has a ramped surface and a well, separated by a shoulder. The check body has a roller biased against the link by a biasing member. The biasing force on the roller must be overcome for the roller to move from the well back over the ramped surface. In this way the door is releasably held in a hold-open position, instead of being closed by wind, accidental movements and the like.

From the foregoing disclosure and the following more detailed description of various preferred embodiments it will be apparent to those skilled in the art that the present invention provides a significant advance in the technology and art of door checks. Particularly significant in this regard is the potential the invention affords for use of door checks in doors with thin cross sections. Additional features and advantages of various preferred embodiments will be better understood in view of the detailed description provided below.

Figure 1:
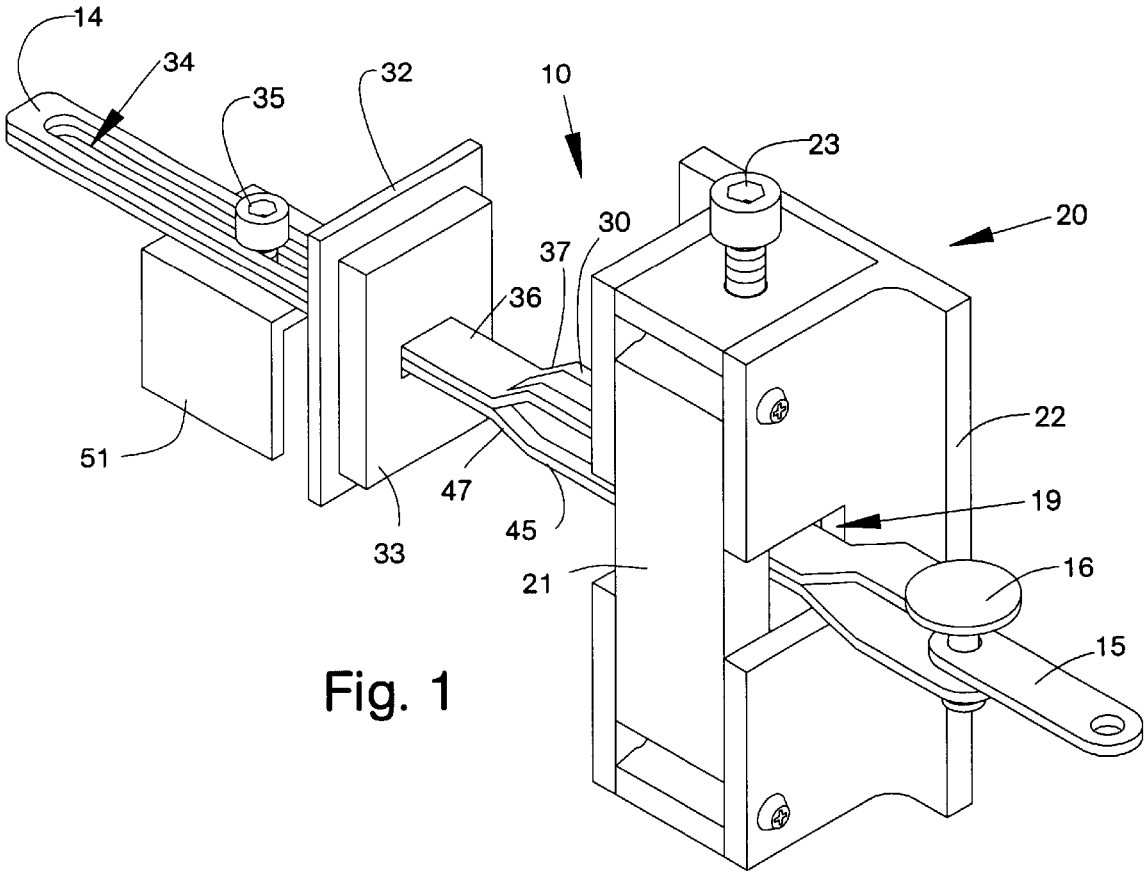
FIG. 1 is a perspective view of a door check for a motor vehicle door in accordance with a preferred embodiment.

It should be understood that the appended drawings are not necessarily to scale, presenting a somewhat simplified representation of various preferred features illustrative of the basic principles of the invention. The specific design features of a door check as disclosed here, including, for example, specific dimensions of the spring, the diameter of the rollers, and the length of the second link, will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation of the door check as illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the hinge assembly disclosed here. The following detailed discussion of various alternative and preferred features and embodiments will illustrate the general principles of the invention with reference to a door check for use in a recreational vehicle door. Other embodiments suitable for other applications, such as door checks for automobiles and trucks, will be apparent given the benefit of this disclosure.

Referring now to the drawings, FIG. 1 is a perspective view of a door check 10, having a main link 14, a check body 20, and, in accordance with a highly advantageous feature, a second link 15. Check body 20 is comprised of inner body 21 and outer body 22. The main link 14 is connected to second link 15 via pivot pin 16. When the door check is at one end of its travel range, the check body 20 abuts against a stop comprising bumper 33 which is supported by a backer 32 and stop pin 38. A shoulder bolt 35, mounted on screw guidance bracket 51, extends into guidance slot 34 to restrict the main link to linear motion as it moves with respect to the bolt.

Figure 2:
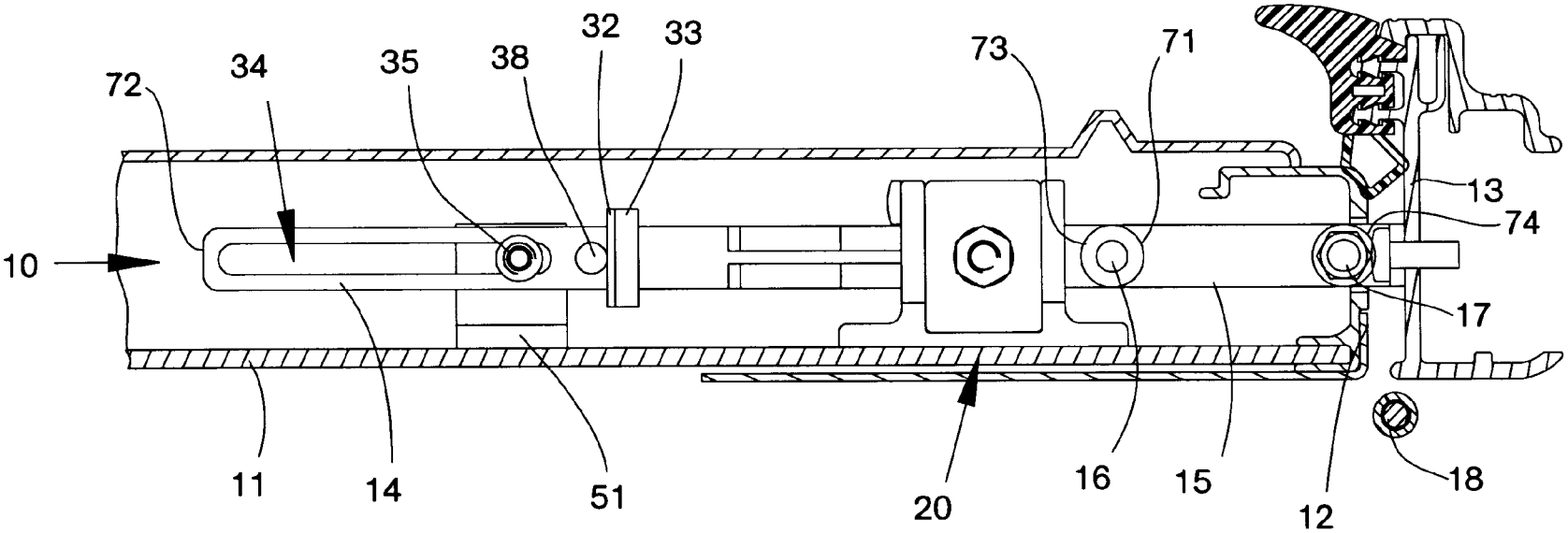
FIG. 2 is a cross section view, partially broken away, of the door check shown in FIG. 1, installed in a door in a closed position.
Figure 3:
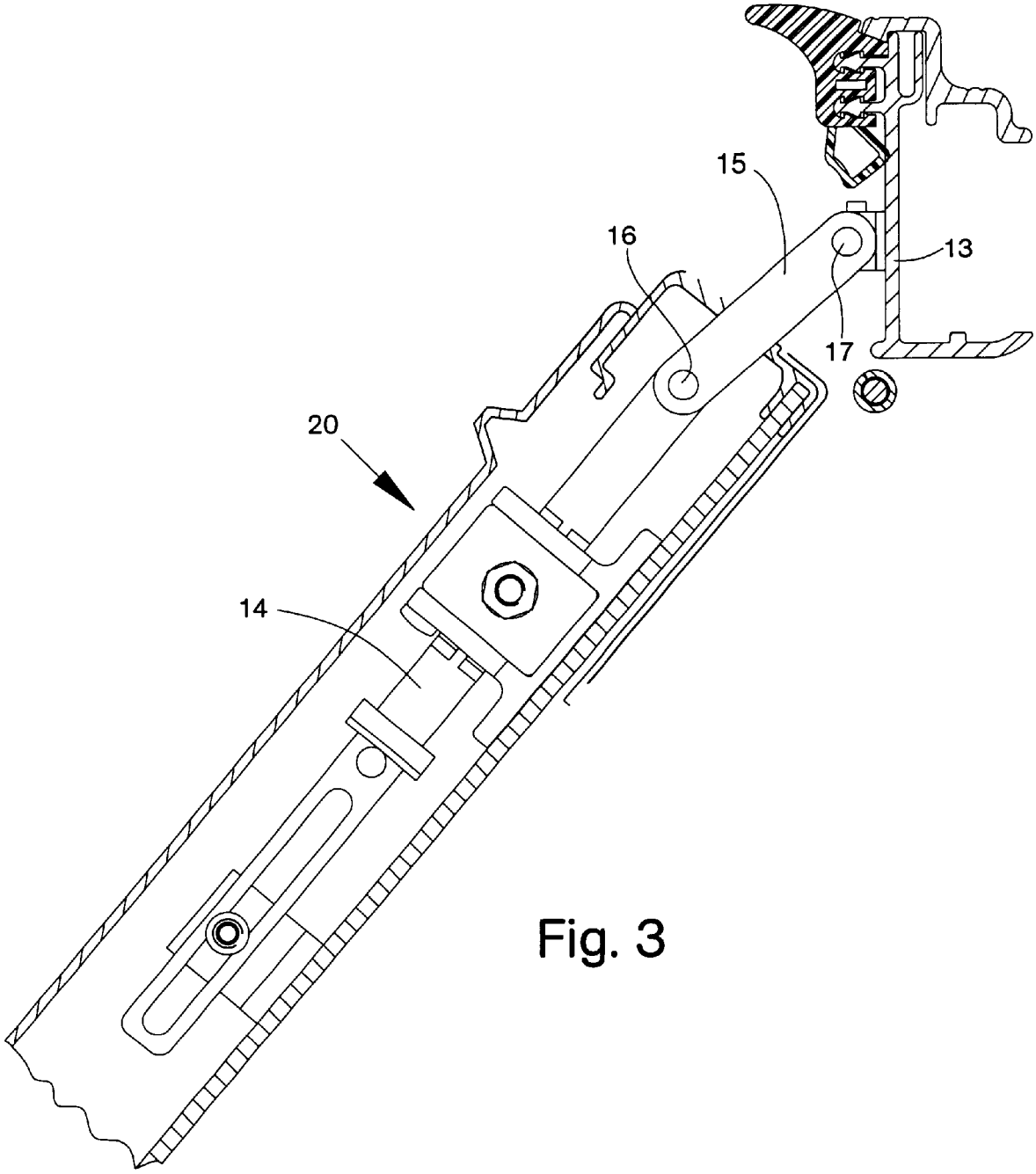
FIG. 3 is a cross section view, partially broken away, of the door check of FIG. 2, shown installed in a door in a partially open position.
Figure 4:
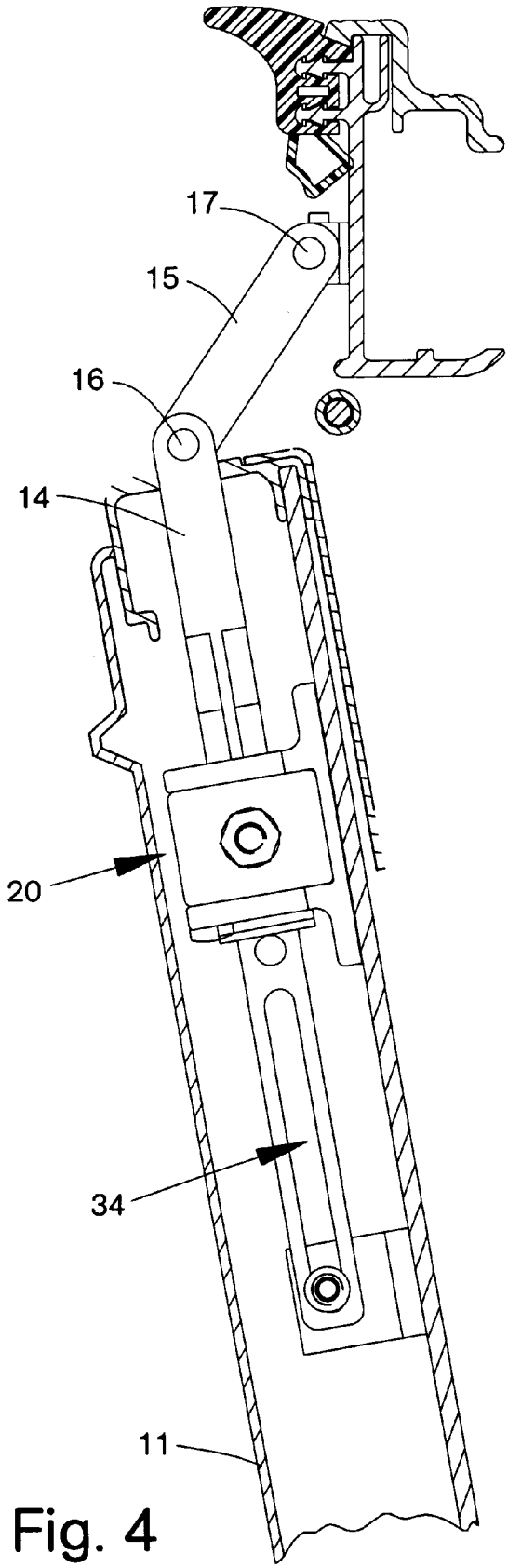
FIG. 4 is a cross section view, partially broken away, of the door check of FIGS. 2 and 3, shown installed in a door in a full open position.

FIGS. 2–4 show a door 11 having a door frame 12 pivotable about door pivot 18. The door check 10 positioned in the door 11 can be cycled with the door over a travel range from a closed position (FIG. 2), to an intermediate open position (FIG. 3), to a full open position (FIG. 4). As the door pivots over the travel range, check body 20 moves with the door, and the main link 14 is slidably received through opening 19 in check body 20. The second link 15 is pivotably attached to the main link 14 with pivot pin 16, and pivotably attached to a fixed member such as a door jamb 13, shown in FIGS. 2–4. In addition to the check body 20, the screw guidance bracket 51 is attached to the door 11.

Main link 14 is seen in FIG. 2 to have a first end 71 and a second end 72 opposite the first end 71, and second link 15 is seen to have a first end 73 and a second end 74 opposite the first end 73.

The check body 20 pivots with the door about a first axis at door pivot 18. As can be seen in FIGS. 3–4, the second link 15 pivots about a second axis at pivot pin 17 as the door and check body move from the closed position. To account for the difference between the first axis and the second axis, main link 14 translates through the opening in the door check 20. This design is especially advantageous for doors having relatively thin cross section, as a component of the motion is converted to translational motion of the main link. This eliminates the need to cut a large hole in the door for the link to pivot, a hole that may produce noise and sealing problems.

Figure 5:
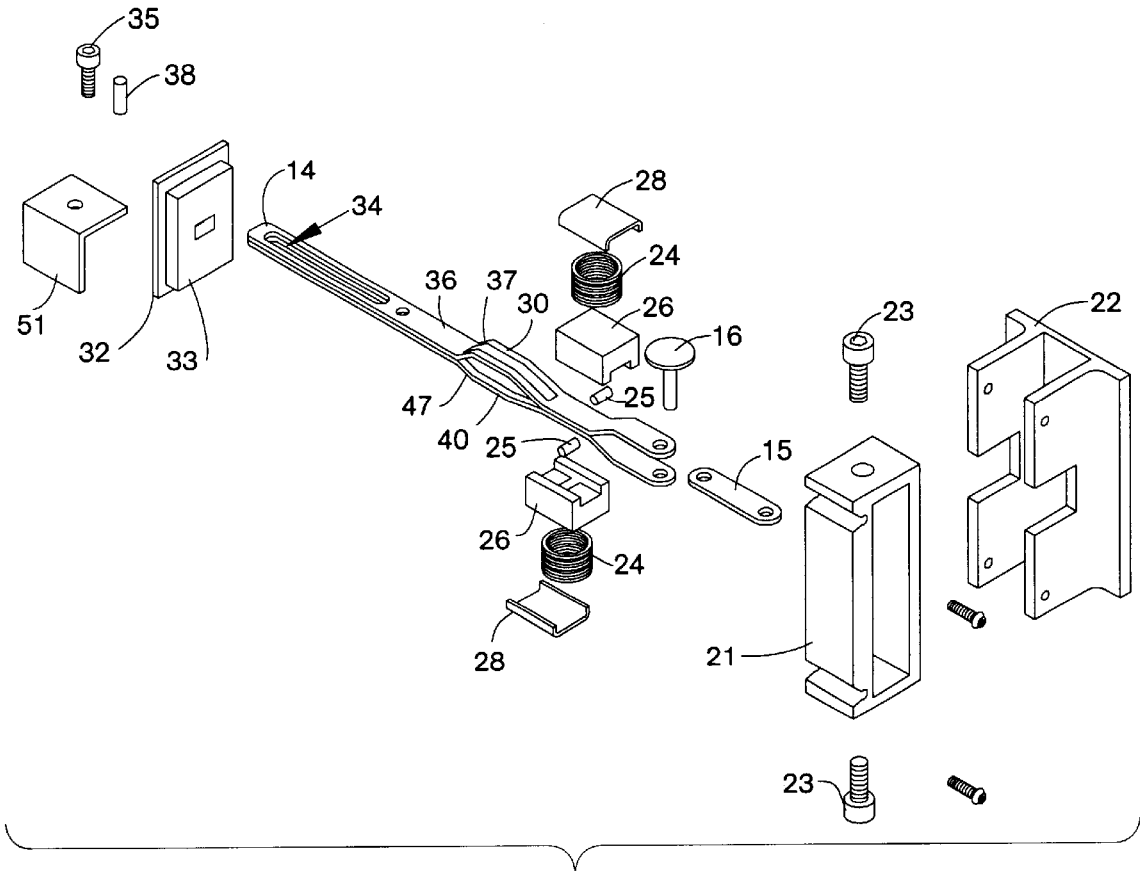
FIG. 5 is an exploded perspective view of the door check of FIG. 1, showing the links and the body.

As seen in the exploded perspective view of FIG. 5, check body 20 comprises an inner body 21 and an outer body 22. Inner body 21 receives a pair of biasing members, such as springs 24, each sandwiched between a spring receiving plate 28 and a roller housing 26. Each roller housing 26 receives a roller 25 which rolls or slides over the surface of the main link 14. Screws 23 are received by the inner housing 21 and contact corresponding spring receiving plates 28. In accordance with a highly advantageous feature, when the screws are tightened, the springs 24 are compressed, and pressure is increased between the rollers 25 and the main link. This allows an assembler to fine tune the roller pressure to account for tolerance variations in the components of the door and the door check.

Main link 14 has ramped surfaces 30, 45, which the rollers 25 must roll over as the door and check body move toward the full open position. Ramped surfaces 30, 40 are separated from well 36 by shoulders 37, 47. When the rollers move to the well, a sufficiently large amount of force is required to overcome the force of the springs and climb back over the shoulders 37, 47, that the door is checked or held in a hold-open position. Thus, small movements of the door 11, whether caused by wind or uncontrolled motion, etc., are not sufficient to move the door back to the closed position. The hold open position extends between the well 36 between shoulders 37, 47 and stop bumper 33.

From the foregoing disclosure and detailed description of certain preferred embodiments, it will be apparent that various modifications, additions and other alternative embodiments are possible without departing from the true scope and spirit of the invention. For example, it will be apparent to those skilled in the art, given the benefit of this disclosure, that multiple ramped surfaces and wells may be used to provide intermediate hold open positions for a door. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A door check comprising, in combination:

a check body having an opening, wherein the check body is adapted to pivot with respect to a fixed member over a travel range;

a main link having a first end and a second end opposite the first end, linearly slidable through the opening of the check body in response to pivoting of the check body; and a second link having a first end pivotably connected to the first end of the main link, in direct contact with the main link and adapted to be pivotably attached to the fixed member at a second end opposite the first end, wherein the second link is pivotable in response to pivoting of the check body, and the first and second ends of the second link are generally collinear with the first and second ends of the main link when the door check is in a closed position.

2. The door check of claim 1 wherein the main link has a ramped surface separated from a corresponding well by a shoulder, and the check body is movable over the ramped surface to a hold-open position at the well.

3. The door check of claim 2 wherein the check body has a roller which rolls over the ramped surface as the check body moves over the travel range, and bias means for biasing the roller against the ramped surface.

4. The door check of claim 3 further comprising a screw inserted into the check body, and a plate positioned between the screw and the bias means, wherein rotation of the screw in one direction urges the plate against the bias means.

5. The door check of claim 1 further comprising a stop attached to the main link, wherein the check body abuts against the stop at a full open position.

6. The door check of claim 1 further comprising a guidance bracket, wherein one of the main link and the guidance bracket has a slot and the other of the main link and the guidance bracket has a bolt which extends into the slot, the slot and bolt cooperating with the check body to restrict the main link to linear motion as the link moves with respect to the check body.

7. A door check comprising, in combination:

a check body having an opening, attachable to a door and pivotable about a first axis;

a main link having a first end and a second end opposite the first end, positioned in the opening of the check body; and a second link having a first end and a second end opposite the first end, pivotably attached to the door at the second end about a second axis different from the first axis, and the first end of the second link is pivotably connected to the first end of the main link;

wherein in response to the check body pivoting about the first axis, the second link pivots about the second axis, and the main link translates through the opening in the check body, and the first and second ends of the second link are generally collinear with the first and second ends of the main link when the door check is in a closed position.

8. The door check of claim 7 wherein the door has a door frame, and the door is pivotable over a travel range from a closed position to an open position, and the main link extends beyond the door frame when the door is in the open position.

9. The door check of claim 7 further comprising a roller amounted in the check body which rolls over the main link, and bias means for biasing the roller against the main link.

10. The door check of claim 9 further comprising a screw inserted into the check body, and a plate positioned between the screw and the bias means, wherein rotation of the screw in one direction urges the plate against the bias means.

* * * * *